US006293535B1

(12) United States Patent
Pfankuch

(10) Patent No.: US 6,293,535 B1
(45) Date of Patent: Sep. 25, 2001

(54) DEVICE FOR INDIVIDUALIZING BLANKS OF PAPER, PLASTIC, OR SIMILAR MATERIALS

(75) Inventor: Claus Karl Pfankuch, Hamburg (DE)

(73) Assignee: Pfankuch Maschinen GmbH, Ahrensburg (DE)

( * ) Notice: Subject to any disclaimer, the term of this patent is extended or adjusted under 35 U.S.C. 154(b) by 0 days.

(21) Appl. No.: 09/457,566

(22) Filed: Dec. 9, 1999

(30) Foreign Application Priority Data

Jan. 16, 1999 (DE) ..... 299 00 725 U

(51) Int. Cl.[7] ..... B65C 9/12; B65H 5/00; B65H 5/22

(52) U.S. Cl. ..... 271/3.23; 271/3.24; 271/4.03; 271/4.06

(58) Field of Search ..... 271/4.03, 4.06, 271/3.23, 3.24, 126; 400/629; 414/797.7

(56) References Cited

U.S. PATENT DOCUMENTS 4,451,027 5/1984 Alper .
4,696,715 * 9/1987 Bahr ..... 156/568 X
5,004,218 * 4/1991 Sardano et al. ..... 271/35 X
5,006,042 * 4/1991 Park ..... 414/795.4 X
5,050,852 * 9/1991 Sawada et al. ..... 271/11 X
5,172,898 * 12/1992 Takahashi ..... 271/10 X
5,326,088 * 7/1994 Newsome ..... 271/3.1 X
5,360,316 * 11/1994 O'Mara et al. ..... 414/798.9 X
5,613,670 * 3/1997 Ballestrazzi et al. ..... 271/3.23

* cited by examiner

*Primary Examiner*—Christopher P. Ellis
*Assistant Examiner*—Kenneth W Bower
(74) *Attorney, Agent, or Firm*—Friedrich Kueffner

(57) ABSTRACT

An individualization and transport device for blanks has a vacuum feeder with an endless belt circulating in a timed drive cycle in a transport direction. The endless belt of the vacuum feeder has an upper belt portion and a lower belt portion. An individualizer is arranged upstream of the vacuum feeder and feeds individual blanks from a stack of blanks onto the lower belt portion of the vacuum feeder at a first transport speed. A continuously moving carrier is arranged downstream of the vacuum feeder and has a second transport speed that is greater than the first transport speed. The endless belt moves at a third transport speed that is synchronized with the second transport speed of the carrier at the moment of transfer of the blank onto the continuously moving carrier.

5 Claims, 3 Drawing Sheets

DEVICE FOR INDIVIDUALIZING BLANKS OF PAPER, PLASTIC, OR SIMILAR MATERIALS

BACKGROUND OF THE INVENTION

1. Field of the Invention

The invention relates to a device for individualizing blanks of paper, plastic, or similar materials, and placing the individualized blanks onto a continuously moving carrier, wherein the device comprises an individualizer that transfers the blanks individually to a vacuum feeder and wherein the continuously moving carrier is arranged downstream of the vacuum feeder in the transport direction. The continuously moving carrier has a higher transport speed than the individualizer.

2. Description of the Related Art

In such known devices, the transfer of blanks from the vacuum feeder onto the carrier is problematic, especially when a position-precise placement is desired.

SUMMARY OF THE INVENTION

It is an object of the present invention to provide a device of the aforementioned kind with which a position-precise placement of the blanks onto the continuously moving carrier is ensured at a high velocity.

In accordance with the present invention, this is achieved in that the individualizer transfers the blanks onto the lower belt portion of the vacuum feeder (upside down transfer), wherein the vacuum feeder is driven in a cycled operation and has a transport speed that is synchronizable with that of the carrier.

Since the blanks, for example, telephone cards etc., are transferred onto the lower belt portion of the vacuum feeder, they are placed smoothly without abrupt transition, i.e., tangentially, onto the surface of the carrier. When the vacuum feeder and the carrier operate at identical speed at the moment of transfer of a blank, a point-precise transfer is ensured. Since the vacuum feeder is driven faster than the individualization process takes place, a gap is provided between the blanks placed onto the vacuum feeder. This gap is used for controlling the operation, for example, by means of a sensor. The sensor for controlling the timed drive cycle of the vacuum feeder is preferably positioned below the vacuum feeder adjacent to the transfer end. The sensor is preferably adjustable in the transport direction of the vacuum feeder.

When the device is advantageously embodied such that at the transfer end of the vacuum feeder pressing rollers are provided which rest and rotate freely on the carrier and are preferably supported on the deflection shaft of the vacuum feeder, the pressing rollers provide a smooth and precise transfer from the vacuum feeder onto the surface of the carrier. The timed drive cycle controls the movement of the vacuum feeder such that the vacuum feeder, upon transfer of a blank onto the surface of the carrier, is always moved at the speed of the carrier so that problems resulting from differing transport velocities are eliminated. The gaps between the blanks are sufficiently large to always ensure acceleration of the intermittently stopped vacuum feeder to the desired transport speed.

DESCRIPTION OF THE PREFERRED EMBODIMENTS

Figure 1:
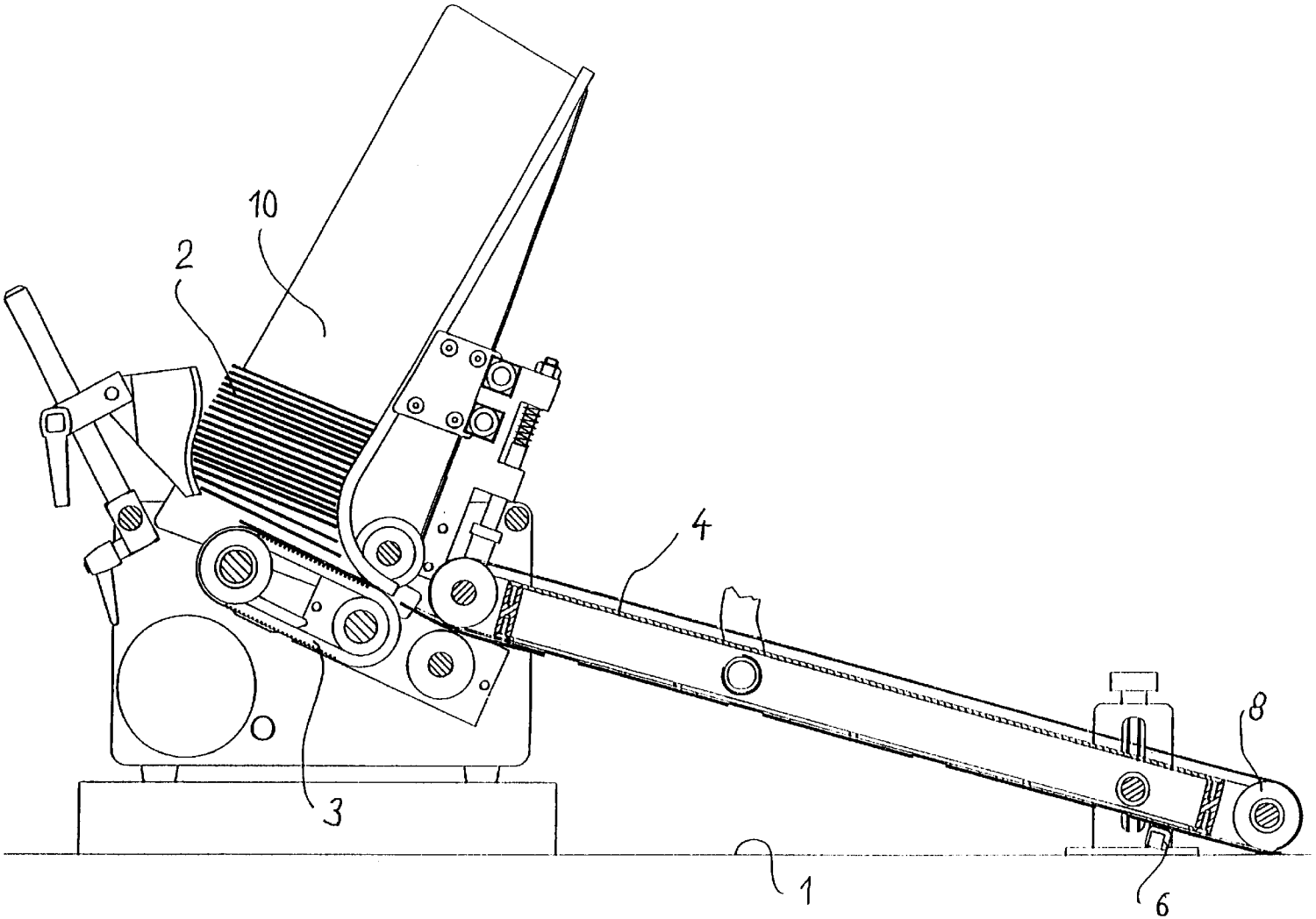
FIG. 1 is a side view of one embodiment of the device according to the invention.
Figure 2:
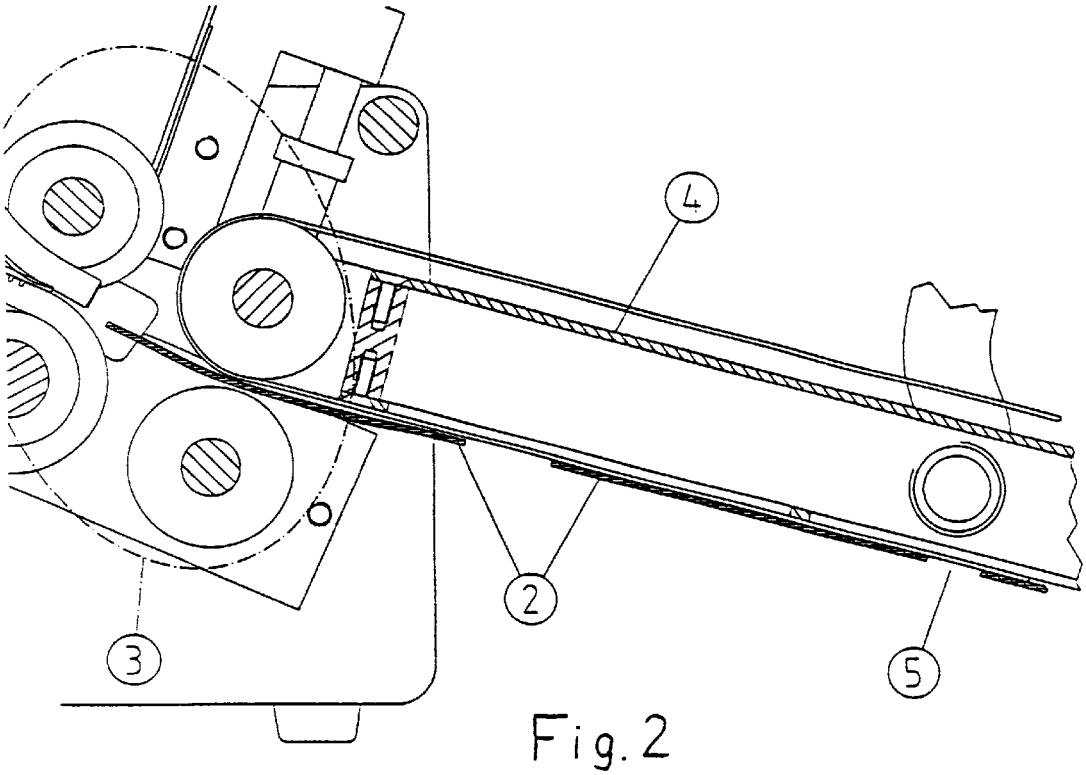
FIG. 2 is a side view of a portion of the device according to FIG. 1 at an enlarged scale, showing the receiving end of the vacuum feeder.
Figure 3:
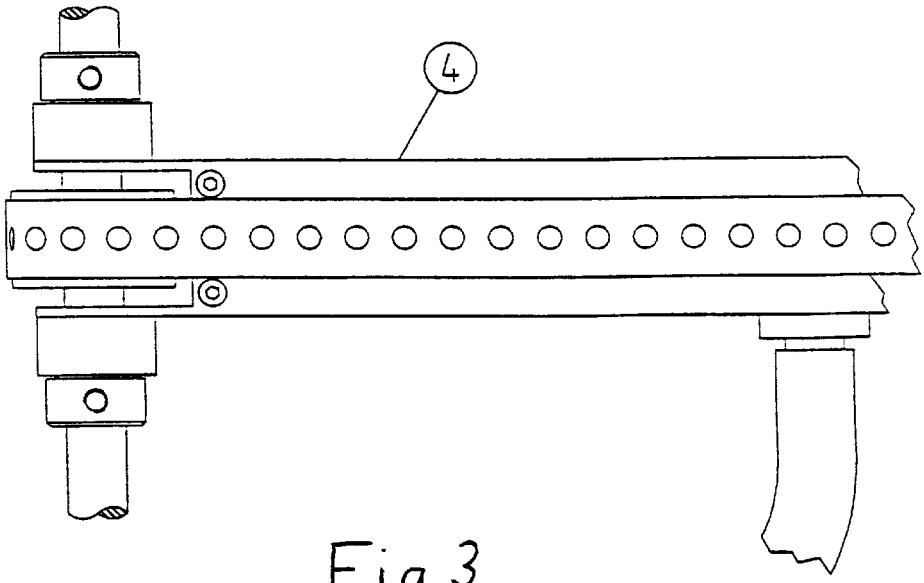
FIG. 3 is a bottom view of the receiving end of FIG. 2.
Figure 4:
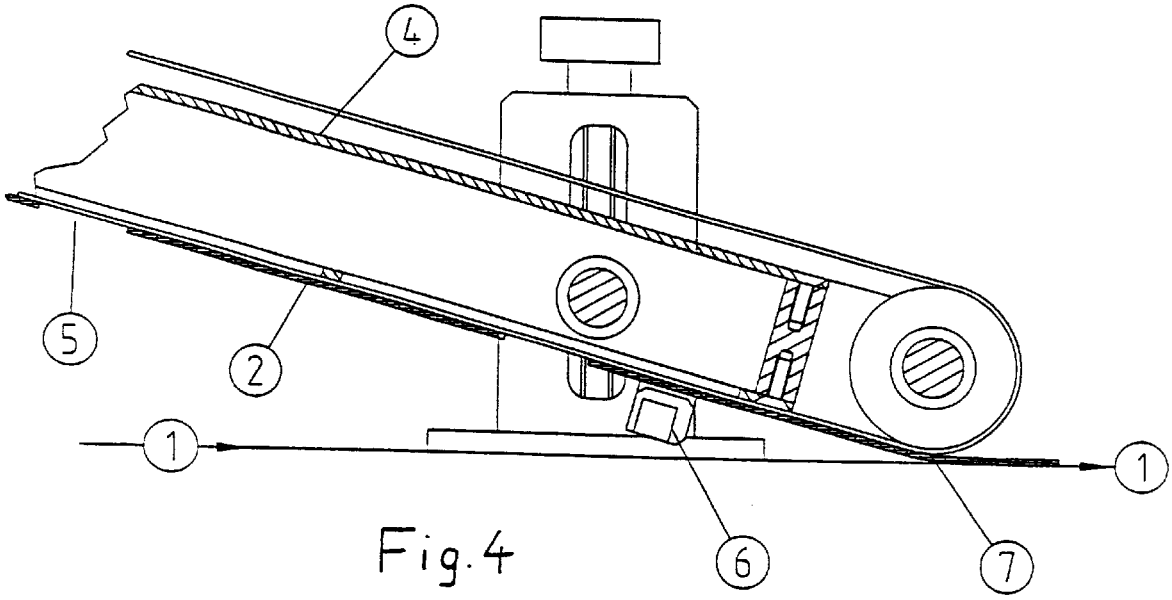
FIG. 4 is a side view of the other end, i.e., the transfer end of the vacuum feeder, shown at the same scale as FIG. 2.
Figure 5:
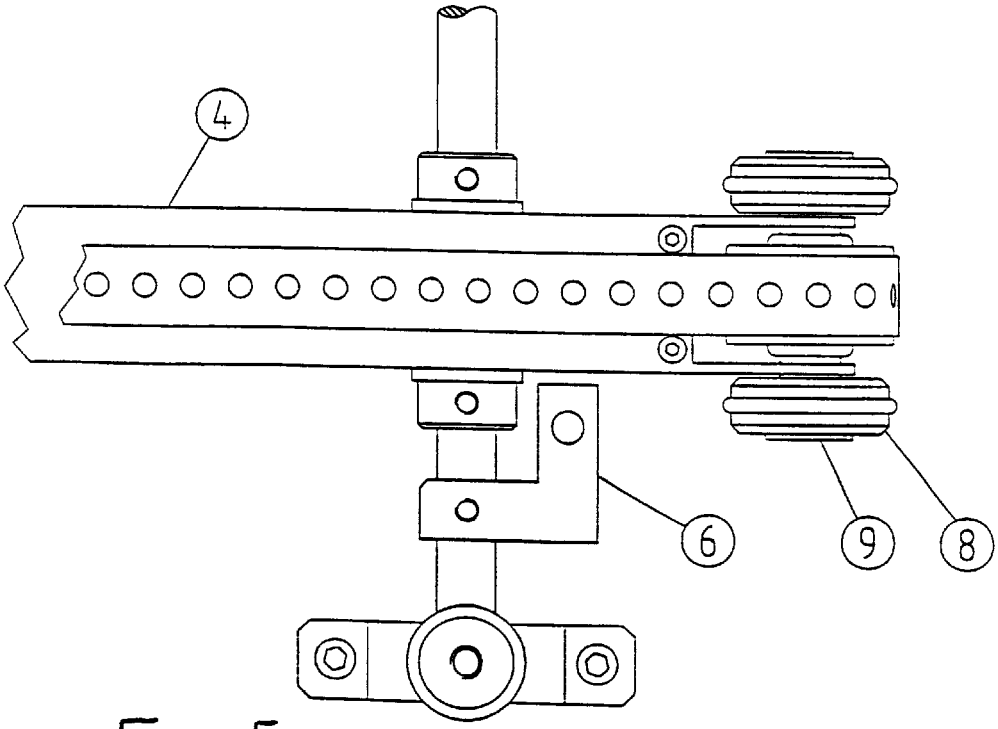
FIG. 5 is a bottom view of the transfer end of FIG. 4.

The device represented in the drawing serves to individualize blanks 2 of paper, cardboard, or plastic, for example, telephone cards etc., which are stacked in a stacking device 10. The lowermost blank in the stack is gripped by an individualizer 3 in the form of an endless feeder and is transferred to the lower belt portion of a vacuum feeder 4 which is also embodied as an endless feeder. The vacuum openings within the endless conveyor belt of the vacuum feeder 4 are supplied with vacuum via a vacuum chamber.

At the transfer end, positioned remote from the individualizer 3, the vacuum feeder 4 meets the surface of the continuously moving carrier 1 onto which the blanks 2 are to be placed individually with great precision. At this transfer end two pressing rollers 8 are provided which freely rotate on the deflection shaft 9 of the vacuum feeder 4 about which the conveyor belt is guided.

A sensor 6 is positioned below the vacuum feeder 4 adjacent to the transfer end. The sensor 6 controls the timed drive cycle of the vacuum feeder 4.

When in operation, the vacuum feeder 4 and the entrained blanks 2 move faster in the forward direction than the individualizer 3 in the form of an endless feeder. Accordingly, gaps 5 will result between the blanks 2. The stream of blanks 2 is controlled by the sensor 6, i.e., when one blank 2 reaches the sensor 6, the vacuum feeder 4 is stopped. The sensor 6 is adjustable in the transport direction in order to be able to detect the position of the blanks 2 in the standstill position and initial position relative to the transport direction. The surface of the carrier 1 is moved continuously and is provided with a synchronization transponder delivering its signals to the input of a synchronization control of one or more servo drives provided for driving the individualizer 3 and the vacuum feeder 4.

A working cycle is triggered by a signal based on detecting an angular position of an angle transponder or a control edge. Triggering the working cycle results in the blank positioned at the sensor 6 to be synchronized with regard to its transport speed to that of the continuously moving carrier 1, for which purpose the signals of the synchronization transponder are employed, and to be placed in a synchronized movement at the belt turning point 7 of the endless vacuum feeder onto the carrier 1. The blank 2 is pressed against the carrier 1 by the freely rotating pressing rollers 8. The position of the product (blank) placed onto the carrier 1 is ensured by bonding agents or adhesive components.

The gaps 5 between the blanks 2 provide at the beginning of the new working cycle sufficient time to accelerate the vacuum feeder 4 to the transport speed of the carrier 1 so that the two transport speeds are synchronized with one another at the moment of transfer of a blank.

While specific embodiments of the invention have been shown and described in detail to illustrate the inventive principles, it will be understood that the invention may be embodied otherwise without departing from such principles.

What is claimed is:

1. An individualization and transport device for blanks, the device comprising:

a vacuum feeder having an endless belt circulating in a timed drive cycle in a transport direction at a first transport speed, the endless belt comprising an upper belt portion and a lower belt portion;

an individualizer arranged upstream of the vacuum feeder and configured to feed individual blanks from a stack of blanks onto the lower belt portion of the vacuum feeder;

a continuously moving carrier arranged downstream of the vacuum feeder;

the individualizer having a second transport speed, wherein the first transport speed is greater than the second transport speed;

the endless belt being configured to move at the first transport speed synchronized with a third transport speed of the continuously moving carrier at a moment of transfer of the blank onto the continuously moving carrier.

2. The device according to claim 1, wherein the vacuum feeder has a transfer end facing the continuously moving carrier and wherein the transfer end comprises pressing rollers rotating freely on the continuously moving carrier.

3. The device according to claim 2, wherein the transfer end of the vacuum feeder has a deflecting shaft for deflecting the endless belt and wherein the pressing rollers are supported on the deflecting shaft.

4. The device according to claim 1, wherein the vacuum feeder has a sensor arranged below the lower belt portion adjacent to the transfer end, wherein the sensor is configured to control the timed drive cycle.

5. The device according to claim 11 wherein the sensor is adjustable in the transport direction of the vacuum feeder.

* * * * *